US008608505B2

(12) United States Patent
Mantay et al.

(10) Patent No.: US 8,608,505 B2
(45) Date of Patent: Dec. 17, 2013

(54) ELECTRICAL CABLE FOR ELECTRICAL TRANSMISSION OF POWER AND DATA

(75) Inventors: Andreas Mantay, Trossingen (DE); Felix Daners, Schaffhausen (CH); Harry Rutschmann, Klettgau (DE)

(73) Assignee: Karl Storz GmbH & Co. KG (DE)

( * ) Notice: Subject to any disclaimer, the term of this patent is extended or adjusted under 35 U.S.C. 154(b) by 62 days.

(21) Appl. No.: 13/332,009

(22) Filed: Dec. 20, 2011

(65) Prior Publication Data

US 2012/0178287 A1 Jul. 12, 2012

(30) Foreign Application Priority Data

Dec. 20, 2010 (DE) ..... 10 2010 063 482

(51) Int. Cl.
*H01R 11/00* (2006.01)

(52) U.S. Cl.
USPC ..... 439/505; 439/623

(58) Field of Classification Search
USPC ..... 439/502, 505, 623, 624
See application file for complete search history.

(56) References Cited

U.S. PATENT DOCUMENTS

| | | | | |
|---|---|---|---|---|
| 5,573,425 | A | 11/1996 | Morisawa et al. | |
| 5,971,799 | A * | 10/1999 | Swade | 439/502 |
| 6,106,328 | A * | 8/2000 | O'Neal | 439/503 |
| 6,663,420 | B1 | 12/2003 | Xiao | |
| 6,672,896 | B1 * | 1/2004 | Li | 439/502 |
| 6,738,856 | B1 | 5/2004 | Milley et al. | |
| 6,790,094 | B1 | 9/2004 | Bergmann et al. | |
| 7,151,950 | B1 | 12/2006 | Oyang et al. | |
| 7,229,302 | B1 * | 6/2007 | Lai | 439/214 |
| 7,344,406 | B2 * | 3/2008 | Wolf | 439/505 |
| 7,488,187 | B2 * | 2/2009 | Wolf | 439/106 |
| 7,591,673 | B2 * | 9/2009 | Chan et al. | 439/502 |
| 2003/0228791 | A1 | 12/2003 | Milan | |
| 2008/0030947 | A1 | 2/2008 | Behrens et al. | |
| 2009/0134915 | A1 | 5/2009 | Hwang et al. | |

FOREIGN PATENT DOCUMENTS

| | | | |
|---|---|---|---|
| DE | 10013247 | A1 | 10/2001 |
| DE | 202005009995 | U1 | 9/2005 |
| DE | 202006002937 | U1 | 4/2006 |
| EP | 2001090 | A2 | 12/2008 |

OTHER PUBLICATIONS

European Search Report; Application No. EP 11 19 2616; Issued: Apr. 27, 2012; Mailing Date: May 9, 2012; 8 pages.
German Search Report; Application No. DE 10 2010 063 482.4; Issued: Nov. 22, 2011; 5 pages.

* cited by examiner

*Primary Examiner* — Thanh Tam Le
(74) *Attorney, Agent, or Firm* — St. Onge Steward Johnston & Reens LLC

(57) ABSTRACT

An electrical cable for power and data transmission between two electronic devices, consisting of a first flexible wire, which includes at least four power transmission lines and at least four data lines as well as a plug according to the USB standard and a multi-polar plug, and of an additional flexible wire, which includes at least two data lines and at least two power transmission lines as well as a USB plug. The first flexible wire and the additional flexible wire together form a Y-shaped cable and make possible a power and a data transmission between two electronic devices simultaneously.

16 Claims, 2 Drawing Sheets

ELECTRICAL CABLE FOR ELECTRICAL TRANSMISSION OF POWER AND DATA

CROSS-REFERENCE TO RELATED APPLICATIONS

The present application claims priority of German patent application No. 10 2010 063 482.4 filed on Dec. 20, 2010, the content of which is incorporated herein by reference.

FIELD OF THE INVENTION

The invention relates to an electrical cable to produce an electrical connection between two electronic devices and to transmit electrical power and data between two electronic devices, in particular between an endoscopic video camera system and a video data storage system

BACKGROUND OF THE INVENTION

Computers as a rule have several hardware interfaces, for example USB (universal serial bus) connections or Firewire connections, that allow peripheral devices to be connected to a computer via cables. The aforementioned hardware interfaces are found as a rule on the back or front of a computer, or, in particular with laptops, on their narrow lateral surface.

A connection according to the USB standard is distinguished in that it is designed to supply a connected peripheral device with power via a standard-gauge USB cable and/or to exchange data with it. For this purpose, voltage of +5 volts and a maximum current strength of 500 mA are provided by a USB connection. A standard-gauge USB cable has four power wires running through it, each of which is connected in a plug with contacts so that it is electrically conductive. The electrical data transmission in the standard-gauge USB cable proceeds here over two wires, one of which transmits the data signal and the other the signal that is inverted in relation to it. Two additional wires serve to power the connected peripheral device. If a peripheral device has a higher power requirement (>500 mA) than can be covered by a single standard-gauge USB cable, then it needs an additional power supply or its own power supply, in particular in the form of a power adapter, that is connected to a power outlet and delivers electrical energy to the peripheral device from the power grid.

Electric cables that can be used to connect two devices are known, for example, from patents DE 202005009 995 U1, DE 202006002937 U1, DE 10013247 A1, U.S. Pat. No. 6,663,420 B1, US 2003/0228791 A1, and U.S. Pat. No. 5,573,425. The aforementioned prior art refers to electrical cables that serve to connect a computer (PC) with peripheral devices such as a mobile telephone or external hard drive. Devices connected by these cables are distinguished either by a comparatively low energy demand and/or in that only small data quantities can be transmitted via these electrical cables. In the event that a peripheral device requires more energy, additional power supply is necessary by using a power adapter.

For a number of endoscopic applications, digital image transmission systems are employed such as, for example, the autoclavable endoscopic IMAGE 1 digital video camera from Karl Storz. With the help of such a camera and an endoscope, minimally invasive procedures can be performed in an operating room, such as visual inspection of internal organs or the removal of tissue samples. Similar image transmission systems are available for industrial endoscopy to be able to inspect technical equipment. With endoscopes of this type, inspections are then possible, for example inside an airplane engine, without dismantling it. Once the defective or worn-out part has been found in the airplane engine, it can then be dismantled with precision and consequently can be repaired economically and quickly.

The aforementioned image transmission systems are distinguished by an increased energy requirement and the large amounts of image data to be transmitted. Here the power supply of the endoscopic video camera as well as the image information generated during use, for display on an image screen or for transfer to a separate database, is simultaneously provided by a single cable intended for power and data transmission. This cable, on its two free ends, is distinguished by a complex, special multi-polar plug that is designed to make the cable connection with a control unit with database, for example the Image 1 hub HD from Karl Storz.

SUMMARY OF THE INVENTION

It is therefore the object of the invention to provide an electrical cable that can connect two electronic devices with one another, in particular an endoscopic video camera system with a video data system, so that improved power supply and data transmission are ensured between the two electronic devices in a simple manner.

This object is fulfilled according to the invention by an electrical cable with the characteristics of patent claim 1. Advantageous refinements of the invention are the subject of the dependent claims.

The invention is thus characterized by an electrical cable that is designed to connect two electronic devices and comprises at least four data lines and at least four power transmission lines for transmitting data and power, and said cable comprises at least two flexible wires whereby the first flexible wire includes at least four data lines and at least four power transmission lines and in addition is designed to connect the two electronic devices with one another. An additional flexible wire is distinguished by having at least two data lines and at least two power transmission lines. Said wire is electrically conductive and is connected with the first flexible wire to form a Y-shaped electrical cable.

In particular, three plugs are mounted on the three cable ends of the inventive electrical cable. One of the two flexible wires is thereby connected with both electronic devices, while the other flexible wire according to the invention is connected only with a single electronic device and with the other flexible wire.

Because only one electrical wire connects the two electronic devices with one another, in an operating room in particular the handling can also be safe and simple: In addition, owing to the inventive configuration of the cable, it becomes possible to feed the electrical power via two separate connections, in particular USB connectors of one or two electronic devices, to a single additional electronic device and to transmit data between the other electronic device and at least one electronic device. In addition to efficient power transmission, good data transfer is also ensured between the electronic devices and can be achieved quickly and easily.

In connection with the inventive Y-shaped structure of the cable, a preferred embodiment comprises a first flexible wire, which on both its ends shows plugs with a different number of electrical contacts by which the two electronic devices are connected with one another. This asymmetrical structure of the plugs ensures that the contacts for power or data transfer of the plugs on one end of the inventive cable have a secure electrical connection with the contacts of the one plug on the other end of the inventive cable. This allows improved manufacture and an optimal adaptation of the plugs and electrical contacts to the contact situation in the particular contact part of both electronic devices, so that an optimal power and data transfer is ensured between the two electronic devices. Preferably, for improved manufacturing quality, the particular data wires and power transfer wires should be sheathed, at least in groups, with insulating linings of different colors; for example, the insulating lining of the data wire could be green and white and the insulating lining of the power transfer wire could be red and black.

In addition, it is proposed that the first and other flexible wires for joint contacting of an electronic device should advantageously each comprise plugs with the same number of electrical contacts. The advantage of these plugs is the presence here of corresponding contacting characteristics, so that these plugs can be configured identically or in compatible manner, thus allowing universal use and in addition simple and cost-effective production. Also, according to the invention the plugs' functionality and security of installation are thereby improved.

One especially advantageous embodiment of the invention foresees that the two plugs of the first and other flexible wires of the inventive cable should be executed as USB plugs. The advantage here is that the inventive electrical cable is suitable for connection with electronic devices equipped with standardized USB contacts. Thus the inventive electrical cable can be plugged into or removed from these standardized USB contacts for use with one or more such electronic devices. A related medical endoscopy and documentation system or video data systems according to the invention are therefore provided with two USB connections.

In another preferred embodiment of the invention, it is proposed that the plugs that serve for common contacting with an electronic device should comprise at least four contacts, so that at least two contacts are connected in each case with one data wire and at least two contacts are connected elastically in each case with one power transmission wire. This makes it possible to produce the inventive cable based on the USB norm. According to the invention, the additional flexible wire thus leads into the plug of the first flexible wire, so that a Y-shaped cable is formed as a result of this arrangement and linkage of the first and other flexible wires. This inventive connection proves especially advantageous because as a result a firm, secure connection is produced between the plug of the first flexible wire and the other flexible wire.

In addition, on the basis of the corresponding asymmetrical shapes in the structure of the two plugs, an installer immediately detects whether a correct mounting of the plugs has occurred or not. With the structure of the plugs as previously described, it also becomes easier to automate installation of the plugs. Another particular advantage can be seen in the fact that the inventive cable makes it possible to avoid using two separate, in particular standard-gauge USB cables, and thus there is less risk of persons becoming entangled with one of the several loose USB cables lying about or stumbling over them and/or thus causing a cable to be pulled out.

In an especially preferred embodiment of the inventive electrical cable, a plug to the preferred video data system of the first flexible wire contains contact surfaces, in particular soldered surfaces, for electrical contacting of data and power transmission lines. Electrically conductively linked to these soldered surfaces are at least two data lines and at least two power transmission lines of the other flexible wire and at least two data lines and at least two power transmission lines of the first flexible wire. Thus the soldered surfaces positioned in the plug are electrically conductively and mechanically firmly connected with the corresponding lines by means of appropriate soldering material. This inventive connection and the structure previously described prove to be especially advantageous because thereby it is possible to solder simply and in automated manner and a mechanically reliable and durable connection is produced between the individual wires and the soldered surfaces of the plug, so that after this connection a plug that is already nearly complete is available.

Besides soldering to connect the contact surfaces with transmission lines, it has also proved possible to connect the lines with one another electrically and mechanically by crimping. This constitutes a connection that is easy to produce in terms of technical production and has the particular disadvantage that the connection can be dissolved under very severe environmental conditions, such as strong vibrations.

In an especially advantageous manner, the plug is produced of electrically non-conducting material, for example of plastic injection moulding. It is precisely the choice of a sterilizable plastic that successfully allows production of an altogether sterilizable inventive electrical cable, which in addition is simple to produce and also is configured so that it can be mounted securely, in particular mechanically.

In another especially preferred embodiment of the inventive electrical cable, it is foreseen that the first flexible wire encompasses at least four data lines and at least four power transmission lines and that these lines are electrically conductively connected with one of the plugs of the first flexible wire, so that two of the at least four data lines and two of the at least four power transmission lines of the first flexible wire are electrically conductively connected with the other plug of the first flexible wire. It is especially essential, moreover, that two of the at least four data lines and two of the at least four power transmission lines of the first flexible wire are electrically conductively connected by the soldered surfaces with the plug of the other flexible wire. Owing to the inventive arrangement and feeding of the data and power transmission lines in the first and other flexible wires of the inventive Y-shaped electrical cable and plugs on the three ends, it is ensured that power and data can be transmitted and/or exchanged between the two plugs of the inventive electrical cable on one side and to the other plug on the other side. It thereby becomes possible that, in simple and secure manner, interconnected electronic devices (both) simultaneously, at a time delay, or controlled by priority, can transmit power and also data via the inventive cable, and via the other flexible plug a greater data and power transmission need can be met than what can be transmitted, for example by several standard-gauge cables according to the USB standard.

Preferably the inventive electrical cable with the first flexible wire is configured in such a way that it can be connected firmly with an endoscopic video camera electrically and mechanically. Thus the firm connection is produced by soldering, crimping, clamping, or bolting, as opposed to the easily dissoluble connection by an insertable and/or removable plug. In this configuration of the invention, the at least four power and at least four data transmission lines that are fed through the first flexible wire are firmly hooked up and electrically connected with two circuit boards installed in the housing of the endoscopic video camera. Each of the two boards of an endoscopic video camera is thereby electrically and mechanically firmly connected with at least two data lines and at least two power transmission lines. One of the boards preferably constitutes the main board and the other constitutes the converter board. As a result of this distribution of the data lines and power transmission lines between the two boards, it is ensured that each board on its part can receive sufficient power feed and sufficient data transmission. Thus it has proved advantageous to distribute the functionalities in the endoscopic video camera according to the invention between two boards in such a way that this particular distribution of the electrical power requirement and of the data transmission requirement is configured in a balanced manner. A very efficient camera design is thereby made possible with this distribution of the functionalities between two circuit boards, and this is reflected, on the one hand, in a better, more compact spatial configuration of the camera design, as well as in a better thermal design and in a better electronic design. It is precisely the configuration with the separate converter board that shows the conversion of an analog image data flow into a digital image data flow, possibly with a certain image processing, and is characterized by a pronounced electrical power requirement as well as a data transfer requirement, and thus proves very advantageous, particularly with respect to the spatial arrangement in the video camera as well as the problems of electromagnetic tolerance with the in- and out-flow of data and electrical power. Owing to the separate configuration of an additional board in addition to the main board that performs the central control functions, some of the image processing with the image processor, and preferably supplies electro-mechanical drives with power, while in addition monitoring the operation of the video camera with its man/machine interface, there is an especially advantageous design of the video camera with related inventive cable, which ensures the required high power supply and data transmission rate.

An additional advantage of the firm connection of the first flexible wire with an electrical device, for example an endoscopic video camera, is seen in the fact that during operation a secure, especially mechanically secure, connection is ensured between the electrical cable and the endoscopic video camera. Because the electrical cable is firmly connected with the endoscopic video camera, there is no risk that the electrical cable could be pulled or knocked out of the endoscopic video camera while said camera is in operation. This can be vital to a patient's survival, especially in emergency medical procedures, since here the physician must be continuously, uninterruptedly informed about the individual steps in a surgical procedure, directly or indirectly via a display unit connected by the inventive cable. In addition, owing to the firm connection of the inventive electrical cable with the endoscopic video camera, reliable transmission of image data for documentation and archiving, for example in a medical video data system, becomes possible. Only by this means is it possible after the operation to explain the individual steps of the procedure to the patient or, if necessary, to plan additional steps for an additional procedure with the imaging display.

Alternatively, another preferred inventive configuration, rather than the firm connection to the boards of the endoscopic video camera, foresees a dissoluble connection in the form of a plug with socket on the video camera in order to produce reliable contacting of the inventive electrical cable via the first flexible wire. Thus, for better security in the medical area, the plug is preferably provided with security elements such as flukes or fixing means, which prevent unintentional release of the plug from the socket.

It is also advantageous here that the electrical cable, as a functional unit with respect to its individual parts and its installation, can be produced at favorable cost and can accordingly be pulled out after a surgical procedure, and before reuse, by employing autoclavable plastics that thickly encapsulate the cable, can be placed completely in a disinfectant bath, for example, and then can be packed in a sterile container to save space.

Hereinafter the invention is explained in further detail with reference to a preferred embodiment that serves as an example.

DETAILED DESCRIPTION OF THE INVENTION

Figure 1:
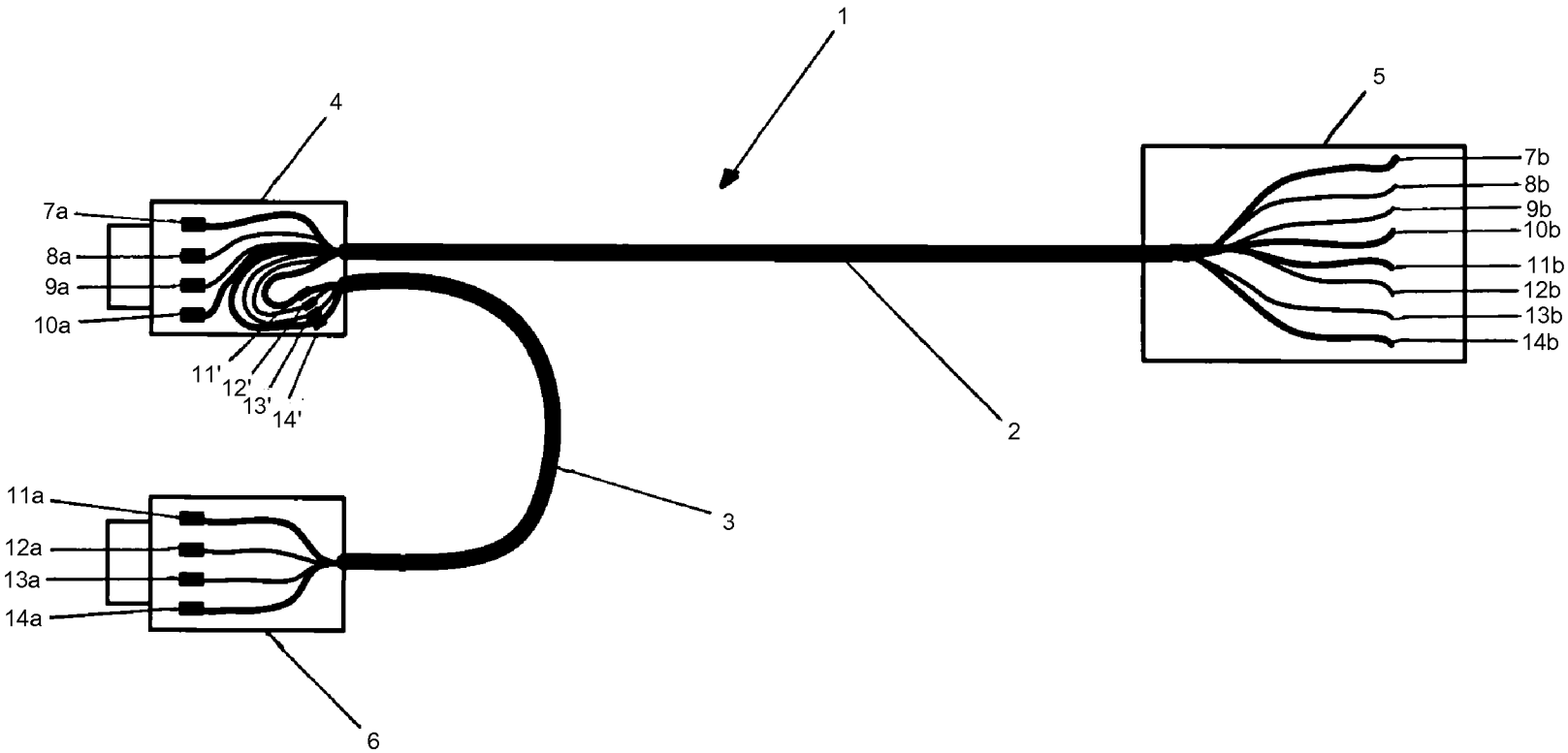
FIG. 1 shows an inventive electrical cable in a longitudinal section.

An inventive electrical cable 1 is shown schematically in longitudinal section in FIG. 1. It includes a first 2 and a second flexible wire 3, such that the first flexible wire 2 comprises two plugs 4 and 5. The plug 4 serves as a connection with an endoscopy and documentation system, for example the TELE PACK X system of Karl Storz, and the plug 5 serves as a connection with an endoscopic video camera, for example an endoscopic IMAGE 1 digital camera from Karl Storz.

The illustrated electrical cable 1 comprises an additional flexible wire 3 with a plug 6, which in addition is connected with an endoscopy and documentation system. The additional flexible wire 3 leading out of the plug 6 leads to the plug 4 of the first flexible wire 2 and is electrically connected with it.

As displayed in FIG. 1, the plug 4 shows contacts 7*a*, 8*a*, 9*a* and 10*a*, which are electrically conductively connected with contacts 7*b*, 8*b*, 9*b* and 10*b* in the plug 5 by a line in each case. Contacts 7*a* and 10*a* or 7*b* and 10*b* are used for power supply, while contacts 8*a* and 9*a* and contact 8*b* and 9*b* are employed for data transmission. Thus the first flexible wire 2 of the inventive cable when plugged in transmits electrical power and data for data transmission between the plugs 4 and 5 and thus from the endoscopy and documentation system to the endoscopic video camera or vice versa.

The plug 6 on the additional flexible wire 3 shows contacts 11*a*, 12*a*, 13*a* and 14*a*. Each contact 11*a*, 12*a*, 13*a* and 14*a* is electrically conductively connected with a line in the other flexible wire 3, so that contacts 11*a* and 14*a* serve for power supply and contacts 12*a* and 13*a* for data transmission.

As shown in FIG. 1, two data and two power transmission lines run from the plug 6 in the other flexible wire 3 and lead finally to the plug 4 of the first flexible wire 2 of the electric cable 1. In the plug 4, each of these lines is then mechanically and electrically conductively connected with one of the soldered surfaces 11', 12', 13' and 14'. Each of these lines is then electrically conductively connected with lines in the first flexible wire 2 selectively via the respectively associated soldered surfaces 11', 12', 13' and 14' and selectively with the associated contacts 11*b*, 12*b*, 13*b* and 14*b* of the plug 5. Thus both power and data can be "slipped through" between the plugs 5 and 6 at once, via the soldered surfaces 11', 12', 13' and 14' in the plug 4, so that another direct power and data connection is produced between the endoscopy and documentation system and the endoscopic video camera by the additional flexible wire 3.

The plugs 4 and 6 are thus configured in accordance with the USB standard, so that two USB contacts on the mobile endoscopy and documentation system can interact in simple and secure manner. This inventive electrical cable, when plugged in, makes it possible to fulfill the increased power supply and data transmission requirement between the connected devices as opposed to a standard-gauge USB cable. In addition, it proves to be very safe to operate, a factor that is particularly important in an application in an operating room or medical emergency situation, because it proves very low in risk since faulty operation or stumbling over the cable is reduced by the inventive structure.

Figure 2:
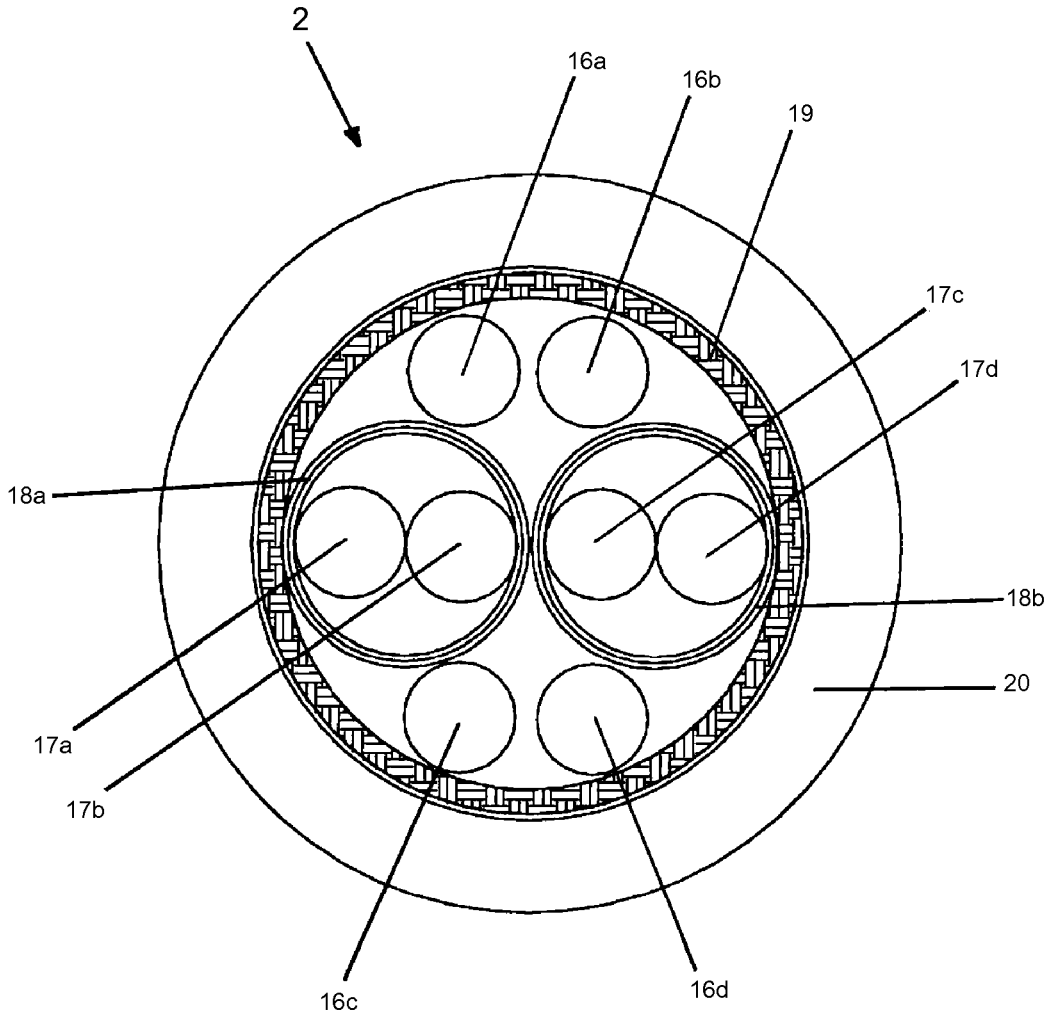
FIG. 2 shows an interior structure of the first flexible wire from FIG. 1 in cross-section (along the line A-A from FIG. 1).

The inner structure of the first flexible wire 2 illustrated schematically in FIG. 1 can be seen in FIG. 2. The first flexible wire 2 contains a number of individual lines that are arranged in groups. Lines for power transmission bear the reference numbers 16*a*, 16*b*, 16*c* and 16*d* and are distributed in several locations inside the first flexible wire 2. In addition, the lines for data transmission 17*a*, 17*b*, 17*c* and 17*d* are joined by pairs to form a group, so that each two data lines arranged to form a pair are enclosed for insulation by a foil 18*a* and 18*b*, which for example can be produced from an aluminum-clad plastic sheet. Finally, the entire arrangement is encased in a metallic protective cover 19, which preferably is produced of galvanized copper wire, and which in turn is encased by an electrically insulating mantle 20. Consequently, a good data transmission is provided without impact from strong impacts from negative electro-magnetic tolerance.

As illustrated in FIGS. 1 and 2, when the inventive Y-shaped electrical cable 1 is plugged in, an additional data and power supply line is provided with the two flexible wires 2 and 3, which makes it possible to realize an increased data exchange in comparison with a standard USB cable and simultaneously to satisfy an increased power supply requirement for a connected peripheral device.

What is claimed is:

1. An electrical cable for electrical power and data transmission between an endoscopic video camera and a data storage device, comprising:

a first flexible wire that comprises at least four data lines and at least four power transmission lines each having first and second ends respectively, and the first ends of the at least four data lines and the at least four power transmission lines are connected to the endoscopic video camera, and the second ends of two of the at least four data lines and the second ends of two of the at least four power transmission lines are terminated in a first plug connected to the data storage device, and a second flexible wire that comprises at least two data lines and at least two power transmission lines each having first and second ends respectively, the first ends of the at least two data lines and the at least two power transmission lines of the second flexible wire are connected to the second ends of two of the at least four data lines and two of the at least four power transmission lines of said first flexible wire, and the second ends of the second flexible wire are terminated in a second plug connected to the data storage device.

2. The electrical cable according to claim 1, wherein the first flexible wire comprises a third plug terminating the first ends of the at least four data lines and the at least four power transmission lines of said first flexible wire, where the third plug has a different number of electrical contacts than said first plug.

3. The electrical cable according to claim 1, wherein the first plug and the second plug each have an equal number of electrical contacts.

4. The electrical cable according to claim 1, wherein the first and second plugs each comprise a Universal Serial Bus (USB) configuration.

5. The electrical cable according to claim 1, wherein in the first plug, contact surfaces, are provided for joint electrical connection of the second ends of two of the at least four data lines and two of the at least four two power transmission lines of the first flexible wire with the first ends of the at least two data lines and at least two power transmission lines of the second flexible wire.

6. The electrical cable according to claim 1, wherein the first end of the first flexible wire is connected with a first circuit board for conversion of analog image signals into digital image signals and a second board for processing an analog image signal, wherein each circuit board is electrically connected with at least two data lines and at least two power transmission lines respectively of the at least four data lines and the at least four power transmission lines of said first flexible wire.

7. The electrical cable according to claim 1, wherein the first flexible wire is hard wired to the video camera.

8. The electrical cable according to claim 1, further comprising a first foil surrounding two of the at least four data lines to form a first data line pair, and a second foil surrounding a remaining two of the at least four data lines to form a second data line pair, where the first data line pair is terminated in the first plug and the second data line pair are connected to the at least two data lines of the second flexible wire.

9. The electrical cable according to claim 8, further comprising a metallic protective cover enclosing the first and second data pairs and the at least four power transmission lines.

10. The electrical cable according to claim 9, further comprising an electrically insulating sheath enclosing the metallic protective cover.

11. An electrical cable for electrical power and data transmission between an endoscopic camera and a storage device, comprising:

a first pair of data lines having first and second ends, the first ends connected to the endoscopic camera and the second ends connected to a first connector that is detachably connected to the storage device;

a first pair of power transmission lines having first and second ends, the first ends connected to the endoscopic camera and the second ends connected to the first connector;

a second pair of data lines having first and second ends, the first ends connected to the endoscopic camera and the second ends connected to a second connector that is detachably connected to the storage device;

a second pair of power transmission lines having first and second ends, the first ends connected to the endoscopic camera and the second ends connected to the second connector.

12. The electrical cable according to claim 11, further comprising a third connector, wherein the first ends of: the first pair of data lines, the first pair of power transmission lines, the second pair of data lines and the second pair of power transmission lines are all terminated in said third connector that is detachably connectable to the endoscopic camera.

13. The electrical cable according to claim 11, wherein the first ends of: the first pair of data lines, the first pair of power transmission lines, the second pair of data lines and the second pair of power transmission lines are all hard wired to the endoscopic camera.

14. The electrical cable according to claim 11, wherein the first and second connectors each comprise a Universal Serial Bus (USB) configuration.

15. The electrical cable according to claim 11, further comprising:

a first circuit board in the endoscopic camera; and a second circuit board in the endoscopic camera;

wherein the first ends of the first pair of data lines and the first pair of power transmission lines are connected to the first board; and wherein the first ends of the second pair of data lines and the second pair of power transmission lines are connected to the second board.

16. The electrical cable according to claim 15, wherein the first board comprises an analog to digital converter and the second board processes an image signal.

* * * * *